US005451119A

United States Patent [19]

Hondulas

[11] Patent Number: 5,451,119

[45] Date of Patent: Sep. 19, 1995

[54] METHOD AND APPARATUS FOR ADJUSTING THE HEIGHT AND SLOPE OF A MANHOLE FRAME AND COVER

[76] Inventor: John L. Hondulas, 351 Silverbell La., Gatlinburg, Tenn. 37738

[21] Appl. No.: 140,500

[22] Filed: Oct. 25, 1993

[51] Int. Cl.[6] ..... E02D 29/14

[52] U.S. Cl. ..... 404/25; 404/26; 52/20

[58] Field of Search ..... 404/25, 26; 52/19, 20; 49/386, 387; 220/334, 371, 374

[56] References Cited

U.S. PATENT DOCUMENTS

| | | | |
|---|---|---|---|
| 3,561,162 | 2/1971 | Goldman | 49/386 |
| 4,038,789 | 8/1977 | Axgärde et al. | 52/19 |
| 5,318,376 | 6/1994 | Prescott, Sr. | 404/25 |

FOREIGN PATENT DOCUMENTS

| | | |
|---|---|---|
| 0317189 | 5/1989 | European Pat. Off. . |
| 1249860 | 10/1971 | United Kingdom . |

*Primary Examiner*—David J. Bagnell
*Assistant Examiner*—Pamela A. O'Connor
*Attorney, Agent, or Firm*—Jacobson, Price, Holman & Stern

[57] ABSTRACT

A barrel-shaped manhole frame for receiving a manhole cover is provided with an inwardly directed peripheral flange at its lower end having circumferentially spaced inclined grooves to receive wedges that can be driven in situ into surrounding earthwork to wedge the frame upwardly and thereby adjust its height and slope to conform with a roadway or sidewalk surface under construction.

12 Claims, 4 Drawing Sheets

METHOD AND APPARATUS FOR ADJUSTING THE HEIGHT AND SLOPE OF A MANHOLE FRAME AND COVER

BACKGROUND OF THE INVENTION

This invention relates to improvements in manhole frames (or barrels) and covers.

Manholes which are used in roadways, sidewalks and the like traditionally are provided with heavy cast iron or like lift-off covers which fit on a barrel-like metal frame at the top of the manhole just below the road or sidewalk surface. Manhole structures provide access to underground sewer, storm, telephone, electric and other utilities. Commonly such frames have an outwardly extending peripheral flange at the bottom which rests on top of a concrete or other manhole cone. During construction of a roadway or sidewalk, difficulties may be encountered in ensuring that the top of the manhole frame is suitably flush and level with the roadway or sidewalk surface insofar as adjustments in the height and/or tilt of the manhole frame involve manipulation in situ of a relatively heavy cast iron or like barrel. In order to provide height adjustments therefore, use is often made of ring-like metal risers placed on the manhole frame. The risers add to the expense of a manhole structure and may tend to buckle with extended usage.

SUMMARY OF THE INVENTION

It is an object of the invention to provide improved manhole frame and cover structures in which means is provided for greatly facilitating manipulation of the frame in situ in a manhole prior to final fixation in order to provide simplified leveling and height adjustments of the frame.

Another object of the invention is to provide an improved method and means for installing a manhole frame on a manhole in a roadway, sidewalk or the like in a manner whereby height and levelling adjustments of the frame are greatly simplified compared with known techniques and may even be carried out by a single worker.

Broadly stated, the invention provides for a barrel-like manhole frame to be adjusted for height and/or tilt, in situ in a manhole, by providing plural circumferentially spaced wedge-like elements to engage under suitable circumferentially spaced surfaces on the frame and selectively driving the wedge-like elements radially outwardly into earth or other surrounding material in which the frame is located to provide a ramp-like camming action between upper inclined surfaces of the wedge-like elements and the spaced surfaces of the frame effective to adjust the height and/or tilt of the frame.

In one preferred form of the invention, for example, the barrel-like manhole frame has an inwardly directed flange at the bottom (rather than an outwardly directed flange as in conventional frames) and the circumferentially spaced surfaces are defined by notches or grooves in the flange to receive the wedge-like elements. Internal vertical strengthening ribs may be provided at the location of each notch.

Additional features and advantages of the invention will become apparent from the ensuing description and claims taken in conjunction with the attached drawings.

DESCRIPTION OF THE PREFERRED EMBODIMENTS

Figure 1:
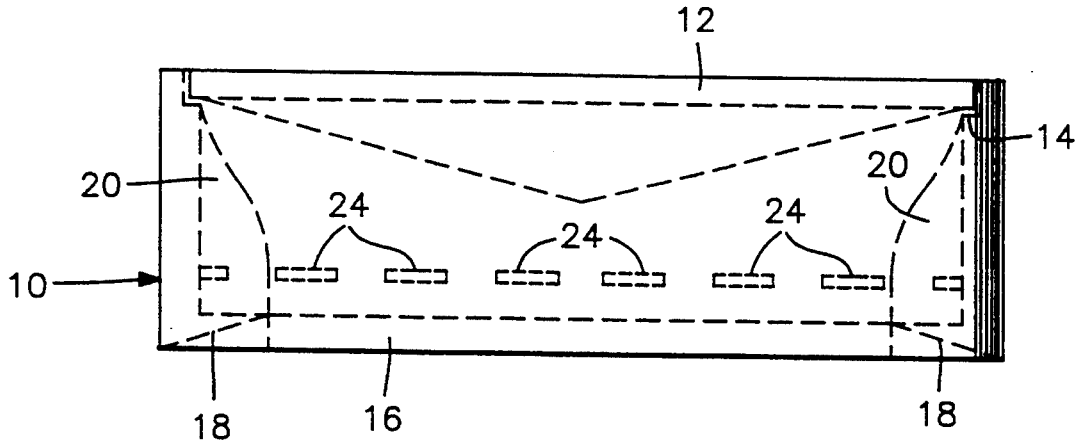
FIG. 1 is a somewhat diagrammatic elevational view of a manhole frame and cover according to the invention.
Figure 2:
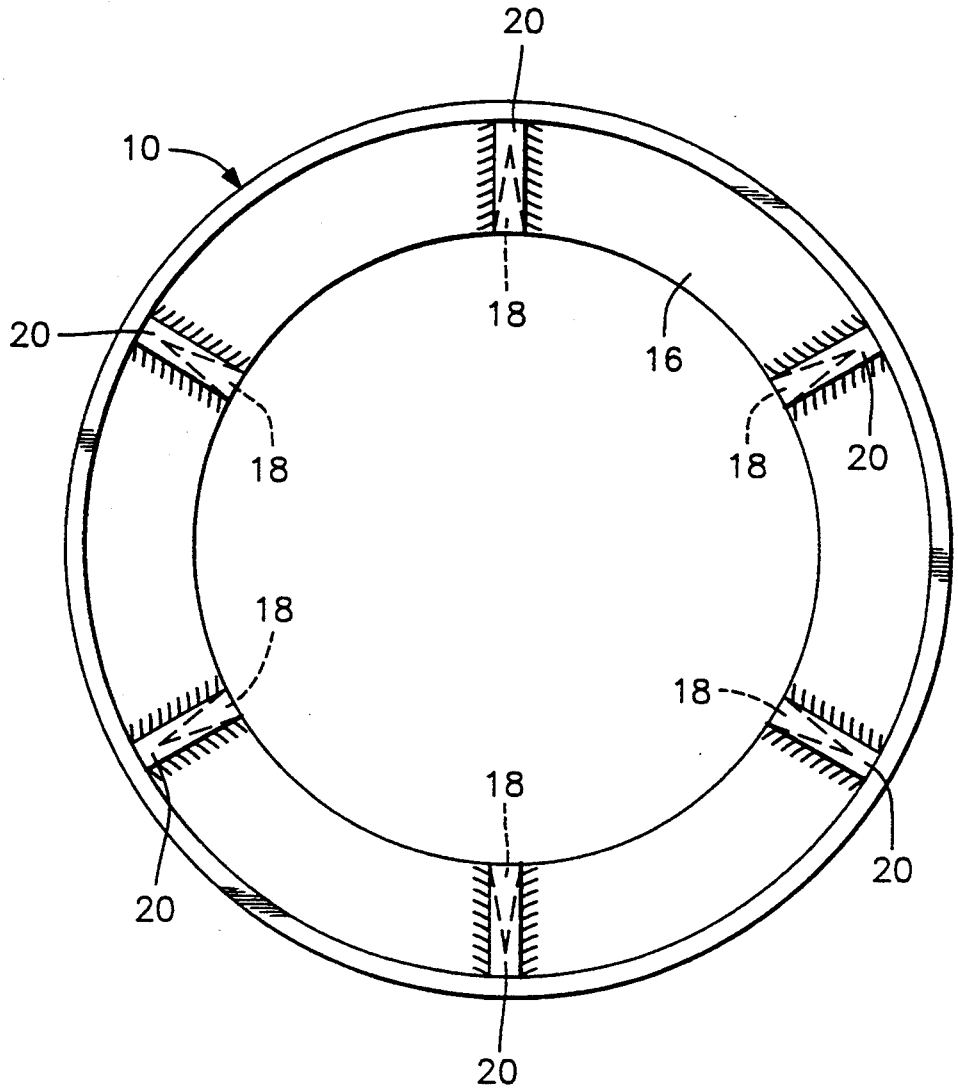
FIG. 2 is a plan view of the frame.
Figure 3:
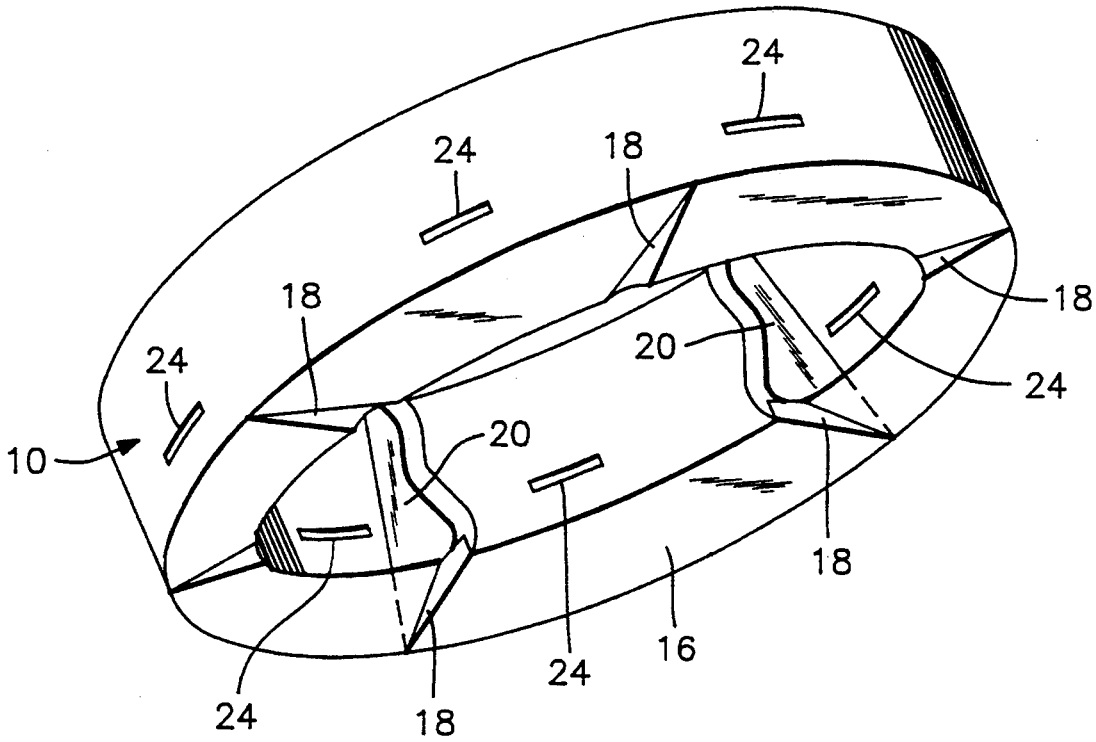
FIG. 3 is a perspective view from below of the frame.

Referring initially to FIGS. 1 to 3, there is shown a barrel-like manhole frame 10 to fit on a manhole structure of concrete or the like in a roadway or sidewalk under construction, and a cover 12 which may, for example, fit on a shoulder 14 at the top of the frame. The frame or cover may be made of cast iron or other similar materials. The manhole structure provides access to underground utilities.

At the bottom frame 10 has an inwardly directed peripheral flange 16 provided with a plurality of circumferentially spaced inclined notches or grooves 18 (the circumferentially spaced surfaces). Vertical strengthening ribs 20 are provided in the frame 10 over each notch. In use, flange 16 fits atop a preconstructed concrete or like manhole in a roadway or sidewalk under construction.

It will be understood that since flange 16 extends inwardly rather than outwardly as in conventional manhole frames, the outer diameter of frame 10 is equivalently greater than that of a conventional frame for the same diameter manhole.

Figure 5:
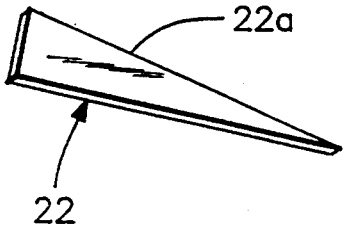
FIG. 5 is a perspective view of a wedge-like element for use with the frame.

In order to provide vertical adjustments of frame 10 in situ in a manhole under construction, so that the top of the frame can be aligned accurately with a roadway or sidewalk surface, use is made of a plurality of wedge-like elements 22 (FIG. 5) of suitable metal or other material, which are selectively driven, as by a hammer, from inside of the frame into the surrounding earthwork or other material with an upper inclined surface 22*a* of a respective wedge engaging one of the notches 18 so that the frame is selectively urged upwardly by a ramp-like camming action. This provides a simple and convenient means for adjusting the height and/or slope or tilt of the frame. After the frame has been properly adjusted, filler material may be inserted under the frame to retain same in place.

Figure 4:
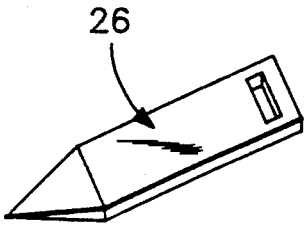
FIG. 4 is a perspective view of a spiked pin for use with the frame.

In order to provide additional stabilization and fixation of the frame 10, it may be optionally provided with a row of horizontal slots 24 to receive pointed pins or bars 26 (FIG. 4) to be driven into the surrounding earthwork or the like.

Figure 6:
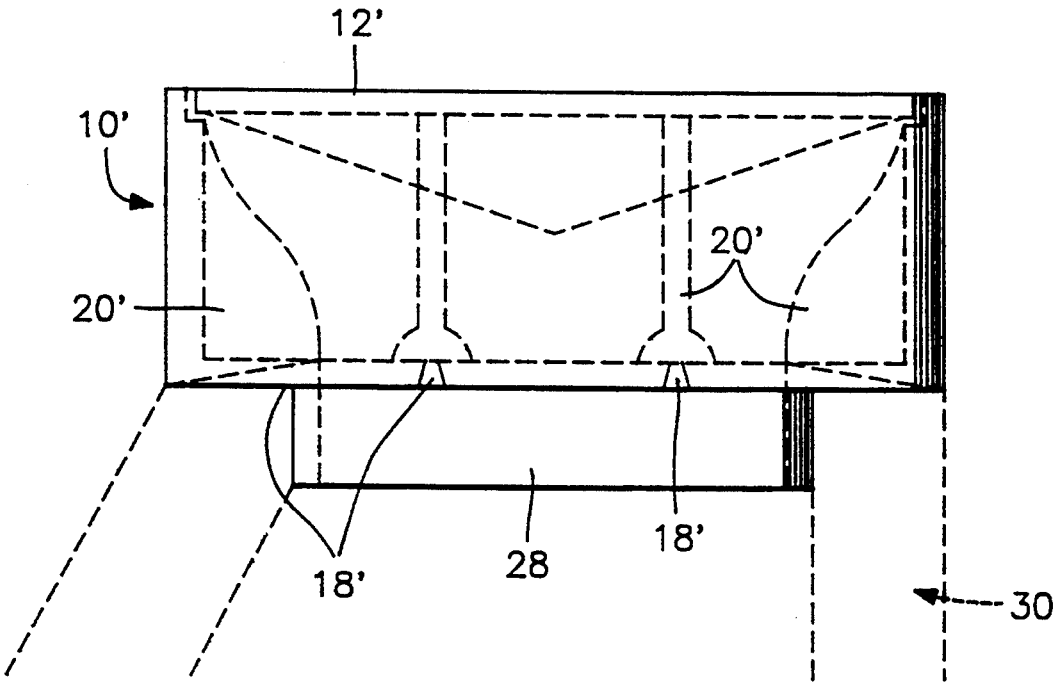
FIG. 6 is a somewhat diagrammatic view of a modified manhole frame according to the invention.
Figure 7:
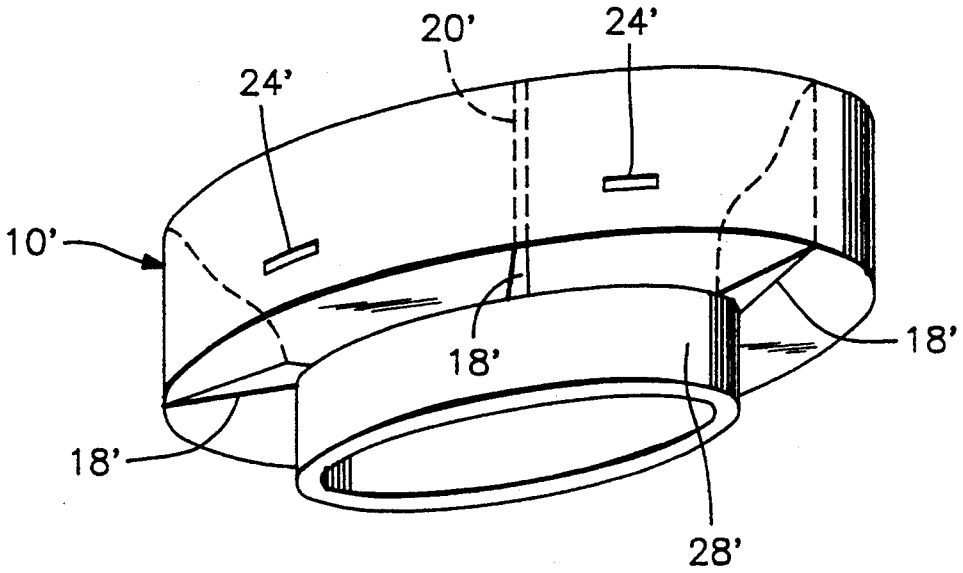
FIG. 7 is a perspective view from below of the modified frame.

FIGS. 6 and 7 show a modified manhole frame 10' similar in all respects to frame 10 previously described except that frame 10' has an integral lower sleeve or extension 28 to fit inside manhole cone 30 and provide further stabilization of the frame, if required. Sleeve 28 should have sufficient clearance with cone 30 to accommodate tilting movements of the frame when being adjusted by means of the previously described wedge elements 22.

Figure 8:
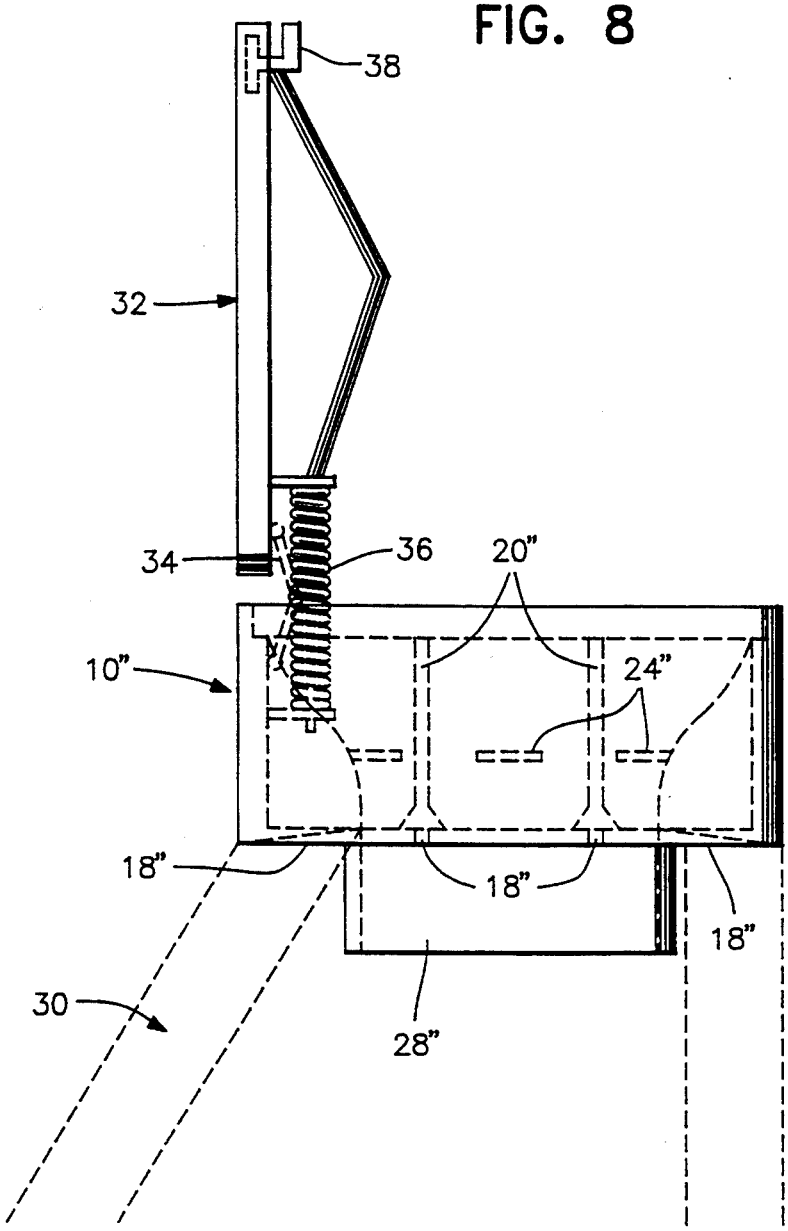
FIG. 8 is a somewhat diagrammatic elevational view of a further modified manhole frame and cover assembly positioned atop a manhole.

FIG. 8 shows a further modified frame 10'', similar to frame 10' but with a manhole cover 32 attached to the top by a hinge 34 and including a spring-loaded assembly 36 and latch 38. The spring loaded assembly makes it easier to lift the cover. Since the frame and cover diameter are, as previously noted, larger than conventional structures, and therefore heavier, these elements may be made of a lightweight steel, aluminum or similar alloy.

Figure 9:
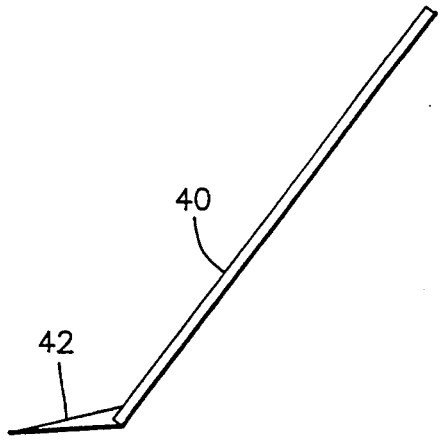
FIG. 9 is an elevational view of a long-handled tool for manipulating a manhole frame according to the invention.

FIG. 9 shows a long-handled bar 40 with a wedge-shaped metal end 42 which can be used in place of the wedge elements 22 to manipulate the frame 10, 10' or 10'' into a raised or tilted position. It can then be stabilized by filler material and/or the bars 26.

While only preferred embodiments of the invention have been described herein in detail, the invention is not limited thereby and modifications can be made within the scope of the attached claims.

I claim:

1. A method of adjusting at least one of the height and slope of a barrel-like manhole frame in situ in a manhole accessing underground utilities under a roadway or other construction to level an upper surface of the frame with a surface of said roadway or other construction comprising the steps of wedging the frame upwardly into a required position by inserting a wedge element under a surface of the frame from inside of the frame driving the wedge element outwardly in engagement with said surface of the frame to raise the frame to the required position and stabilizing the frame in the required position.

2. A method as defined in claim 1 wherein the wedge element comprises a wedge-shaped end of a long handled tool and the tool is used to wedge the frame upwardly.

3. A method as defined in claim 1 wherein the stabilizing step is effected by inserting filler material under the frame.

4. A method as defined in claim 1 wherein the stabilizing step is effected by driving pointed plate-like elements into material surrounding the frame through circumferentially spaced slots in the frame.

5. A method of adjusting at least one of the height and slope of a barrel-like manhole frame in situ in a manhole accessing underground utilities under a roadway or other construction to level an upper surface of the frame with a surface of said roadway or other construction comprising the steps of wedging the frame upwardly from inside of the frame into a required position and stabilizing the frame in the required position wherein the wedging step is effected by driving circumferentially spaced wedge elements from inside of the frame into material surrounding the frame, with upper inclined surfaces of the wedge elements engaging corresponding circumferential surfaces of the frame with a ramp-like camming action.

6. A barrel-shaped manhole frame for fitting on a manhole under a roadway, sidewalk or the like said frame having a peripheral wall formed with circumferentially spaced surfaces against which wedge elements can be engaged for wedging the frame upwardly in situ to level an upper end of the frame with a surface of the roadway, sidewalk or the like wherein said peripheral wall has a lower end formed with a peripheral flange and said surfaces comprise radial grooves extending across the entire width of the flange.

7. A manhole frame as defined in claim 6 wherein the flange is directed inwardly from the peripheral wall.

8. A manhole frame as defined in claim 7 wherein the peripheral wall includes internal, vertically extending reinforcing ribs positioned above the respective grooves.

9. A manhole frame as defined in claim 7 wherein the flange is provided with a downwardly directed sleeve to fit in a manhole cone for stabilizing the frame.

10. A manhole frame as defined in claim 6 wherein the peripheral wall is provided with circumferentially spaced slots formed through the wall to receive plates to be driven into material surrounding the frame for stabilizing same.

11. A manhole frame as defined in claim 6 wherein the frame is provided with a hinged manhole cover.

12. A manhole frame as defined in claim 11 including a spring-loaded assembly connected between the frame and the cover to assist in raising the cover.

* * * * *